United States Patent [19]

Jundt et al.

[11] 4,265,204

[45] May 5, 1981

[54] IGNITION CONTROL SYSTEM WITH CLOSURE ANGLE INDEPENDENT OF RESIDUAL ENERGY STORED IN IGNITION COIL

[75] Inventors: Werner Jundt, Ludwigsburg; Herman Roozenbeek, Schwieberdingen, both of Fed. Rep. of Germany

[73] Assignee: Robert Bosch GmbH, Stuttgart, Fed. Rep. of Germany

[21] Appl. No.: 50,316

[22] Filed: Jun. 20, 1979

[30] Foreign Application Priority Data

Jul. 12, 1978 [DE] Fed. Rep. of Germany ..... 2830557

[51] Int. Cl.[3] ..... F02D 1/00

[52] U.S. Cl. ..... 123/418; 123/406

[58] Field of Search ..... 123/117 R, 148 E

[56] References Cited

U.S. PATENT DOCUMENTS

| | | | |
|---|---|---|---|
| 3,937,193 | 2/1976 | Kim | 123/117 R |
| 4,036,200 | 7/1977 | Kuehn | 123/148 E |
| 4,088,927 | 5/1978 | Adler et al. | 123/148 E |
| 4,136,659 | 6/1979 | Smith | 123/148 E |
| 4,174,696 | 11/1979 | Jundt et al. | 123/117 R |
| 4,176,645 | 12/1979 | Jundt et al. | 123/148 E |

*Primary Examiner*—Charles J. Myhre
*Assistant Examiner*—Raymond A. Nelli
*Attorney, Agent, or Firm*—Frishauf, Holtz, Goodman & Woodward

[57] ABSTRACT

The closure angle of an interrupter switch connected in series with the primary winding of an ignition coil is varied as a predetermined function of engine speed by charging and discharging of an integrator circuit which in turn changes the cut-in threshold of a threshold circuit controlling the operation of the interrupter switch. When the spark repetition rate becomes sufficiently high for residual energy to be stored in the coil when the interrupter switch closes, this type of control results in an undesired decrease of closure angle. Therefore, in the present system, the operation of the charging circuit for the integrator circuit is always delayed until the current through the primary winding reaches a predetermined minimum value exceeding the maximum possible residual current in the primary winding when the interrupter switch first closes. The charging circuit thus always operates from the same initial condition, preventing undesired changes in the closure angle at high speeds.

5 Claims, 2 Drawing Figures

Figure 1:
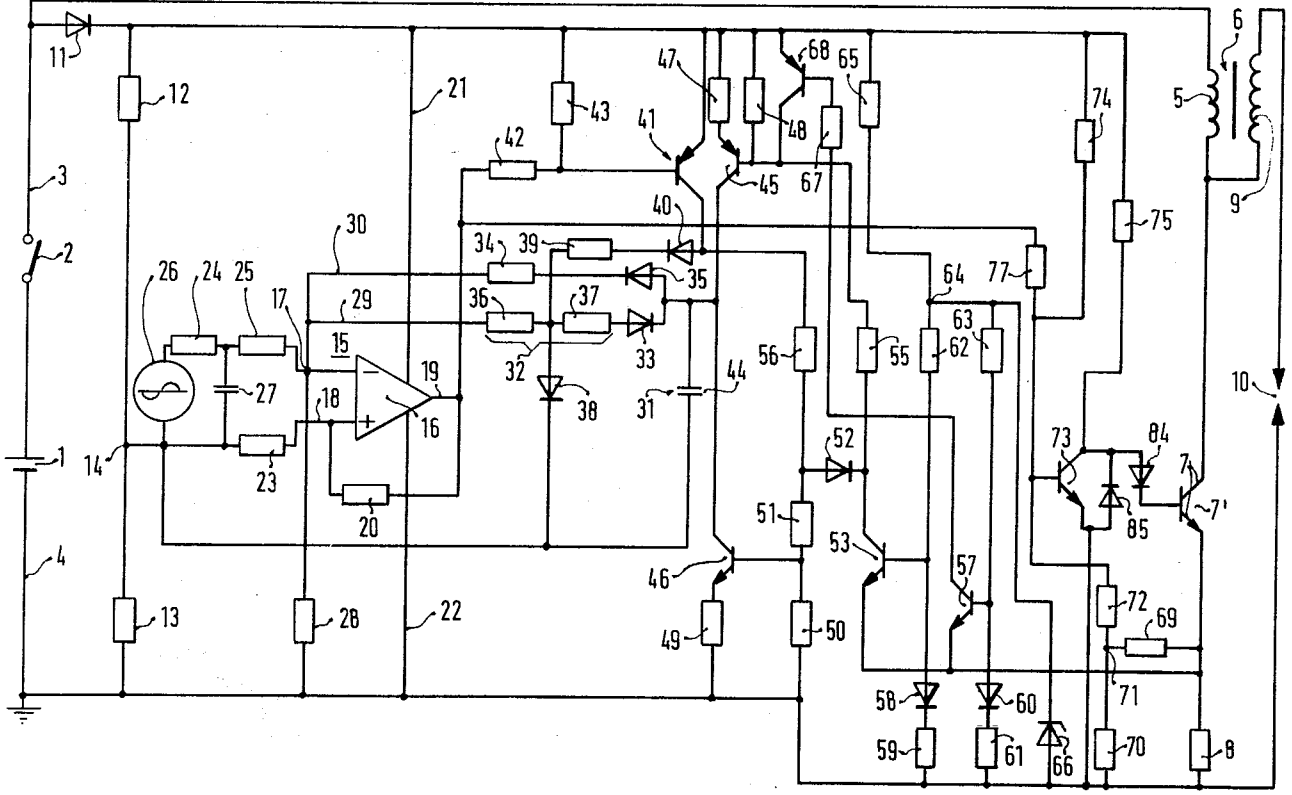

IGNITION CONTROL SYSTEM WITH CLOSURE ANGLE INDEPENDENT OF RESIDUAL ENERGY STORED IN IGNITION COIL

Cross reference to related applications and publications: U.S. Pat. No. 4,176,645.

The present invention relates to ignition systems and particularly to ignition systems in which the closure angle of an interruptor switch connected in series with primary winding of the ignition coil is varied as a predetermined function of engine speed.

BACKGROUND AND PRIOR ART

An ignition system of the above-described type is disclosed in U.S. Pat. No. 4,176,645. In the type of ignition system disclosed therein the closure angle varies relatively exactly according to the predetermined function as long as the speed of the engine (and the number of cylinders) results in an ignition repetition rate which is below a maximum value in which residual storage effects in the output stage become noticeable. If, however, this maximum value is exceeded, an undesired decrease in the closure angle relative to the desired closure angle results for the following reasons. In the known system, the closure angle control takes place by a charging and discharging of an integrator circuit during the time the interrupter switch is closed. Specifically, the charging of the integrator starts as the interrupter switch closes and continues until the current through the primary winding of the ignition coil reaches a predetermined limiting value. At this time a discharge of the integrator circuit commences. Above a particular ignition repetition rate, residual energy will still be stored in the ignition coil when the interrupter switch closes. This causes the current through the interrupter switch to jump to a value corresponding to this residual energy when the switch closes. The time for the current through the primary winding to reach the predetermined limiting value, that is the charging time of the integrator circuit is thus decreased, while the discharge time remains the same. The final value of voltage across the integrator circuit which in turn determines the threshold value of a threshold circuit controlling the interrupter switch therefore changes at high engine speeds for a given number of cylinders in a direction causing an unwanted decrease in the closure angle.

THE INVENTION

It is an object of the present invention to prevent the above-mentioned undesired decrease in the closure angle. The object of the present invention is thus to allow the closure angle to vary as a predetermined function of speed throughout the whole speed range of the engine, independently of any residual energy stored in the ignition coil.

In accordance with the present invention, the means which supply DC current to the integrator circuit operate only after the current through the primary winding reaches a predetermined minimum value which exceeds the maximum residual current value present in the primary winding of the ignition coil at the highest engine speed. The control of the closure angle is achieved by a shifting of the cut-in threshold of a threshold circuit which operates the interrupter switch, as in the known circuit, but the shift of the cut-in threshold only takes place when the current through the primary winding has a predetermined minimum value, thereby setting the same initial conditions for the charging of the integrator circuit throughout the whole speed range.

DRAWING ILLUSTRATING A PREFERRED EMBODIMENT

FIG. 1 is a circuit diagram of a preferred embodiment of the ignition system according to the present invention; and FIGS. *2a–2e* are schematic timing diagrams of signal variation at different points in the circuit of FIG. 1.

The ignition system of FIG. 1 is to be used in an internal combustion engine and, more particularly, in an internal combustion engine in a motor vehicle. The source of energy is a battery 1, which may be the battery of the motor vehicle. The positive terminal of battery 1 is connected through an operating switch 2 to the positive supply line 3, while the negative terminal of battery 1 is connected to a line 4 which is at reference potential. The positive supply line 3 is connected to the negative supply line 4 through a series circuit including the primary winding 5 of an ignition coil 6, an electronic interrupter switch 7 and a monitoring resistor 8.

In the circuit shown on FIG. 1, the electronic interrupter switch is comprised by the emitter-collector circuit of a transistor 7'. The collector of transistor 7' is connected to one end of the secondary winding 9 of ignition coil 6 whose other end is connected to one terminal of a spark plug 10 whose other terminal is connected to reference potential. Of course secondary winding 9 of ignition coil 6 may be connected to a plurality of spark plugs through a distributor.

The positive supply line 3 is also connected to the anode of a diode 11 whose cathode is connected through a voltage divider including resistors 12 and 13 to the negative supply line. The common point of resistors 12 and 13 is denoted by reference numeral 14. The potential at circuit point 14 is approximately half of the battery potential.

The ignition system includes a threshold switch 15 which, in the example shown in FIG. 1, is an operational amplifier having an inverting input 17 and a direct input 18. A positive feedback resistor 20 is connected between output 19 of operational amplifier 16 and its direct input. Further, operational amplifier 16 is connected through a line 26 to the cathode of diode 11 and through a line 22 to the negative supply line 4. The direct input 18 of operational amplifier 16 is connected through a matching resistor 23 to circuit point 14. The inverting input 17 of operational amplifier 16 is further connected through a pair of resistors 24, 25 to one side of a timing signal generator 26. The other side of timing signal generator 26 is connected to circuit point 14. The common point of resistors 24, 25 is connected through a noise filtering capacitor 27 to circuit point 14.

Timing signal generator 26, in a preferred embodiment, is an AC generator and furnishes an AC voltage which has the shape shown in the voltage (U) vs. time (t) diagram of FIG. *2a*. The wave shape shown on the left side of FIG. *2a* corresponds to low engine speeds $n_n$ while that on the right side of the figure corresponds to high engine speeds $n_h$. Inverting input 17 is further connected through a resistor 28 to negative supply line 4 and through two parallel lines 29, 30 to an integrator 31. Integrator 31 is shown as a capacitor. The voltage across capacitor 31 constitutes a control voltage whose value determines the switch-in threshold U2 (FIG. *2a*). Interconnected between line 29*a* and capacitor 31 is a series circuit including resistance 32 and a diode 33 whose cathode is connected to capacitor 31. Interconnected between line 30 and capacitor 31 is a series circuit including a resistor 34 and a diode 35 whose anode is connected to capacitor 31. Resistance 32 includes two resistors 36, 37, the common point of resistors 36, 37 being connected to the anode of a diode 38 whose cathode is connected to circuit point 14. The common point of resistors 36, 37 is further connected through a resistor 39 and a diode 40 to the collector of a transistor 41. The base of transistor 41 is connected through a resistor 42 to the output 19 of operational amplifier 16 and through a resistor 43 to the cathode of diode 11. Transistor 41 is a pnp transistor. Its emitter is connected to the cathode of diode 11. Although integrator 31 is shown as being a capacitor it could, of course, also be a capacitor used in conjunction with an operational amplifier (not shown).

Integrator 31 is further connected to the collector of a first (pnp) control transistor 45 as well as with the collector of a second (npn) control transistor 46. The emitter of first control transistor 45 is connected through a resistor 47 and its base through resistor 48 to the cathode of diode 11, so that a constant current appears in the emitter-collector circuit of transistor 45. The above-described network therefore constitutes a constant current source. Similarly, the emitter of second control transistor 46 is connected through a resistor 49 and its base through a resistor 50 to the negative supply line 4, whereby this network also constitutes a constant current source. The base of second control transistor 46 is connected through a resistor 51 to the anode of a blocking diode 52. The cathode of blocking diode 52 is connected to the collector of an npn transistor 53 and through a resistor 55 to the base of first control transistor 45. The anode of blocking diode 52 is further connected through a resistor 56 to the collector of transistor 41.

Transistor 7' is preferably connected as a Darlington circuit. The common point of transistor 7' and monitoring resistor 8 is connected directly to the emitter of transistor 53 and that of a further transistor 57. The base of transistor 53 is connected through a diode 58 and a resistor 59 to the negative supply line, while the base of transistor 57 is connected through a diode 60 and a resistor 61 to the negative supply line. The base of transistors 53 are connected, respectively, through a resistor 62 and a resistor 63 to a circuit point 64. Circuit point 64 is connected through a resistor 65 to the cathode of diode 11. Circuit point 64 is further connected through a Zener diode 66 to the negative supply line 4. Zener diode 66 provides a stabilized voltage for the base voltage dividers 62, 58, 59 and 63, 60, 61 of transistors 53, 57 respectively. The collector of transistor 57 is connected through a resistor 67 to the base of an additional transistor 68. The emitter of transistor 68 is directly connected to the cathode of diode 11; the collector of transistor 68 is connected directly to the base of control transistor 45.

A series circuit including resistors 69 and 70 is connected in parallel with monitoring resistor 8. The common point 71 of resistors 60 and 70 is connected through a resistor 72 to the base of a driving transistor 73. The base of transistor 73 is connected through a resistor 74 to the cathode of diode 11, while the collector of transistor 73 is connected thereto through a resistor 75.

The base of transistor 73 is connected to the output of operational amplifier 16 through a resistor 77. The collector of transistor 73 is connected to the base of transistor 7' through a diode 84, the anode of diode 84 being connected to the collector of transistor 73. Further, the cathode of a diode 85 is also connected to the collector of transistor 73. Its anode is connected to the emitter of transistor 73.

Figure 2:
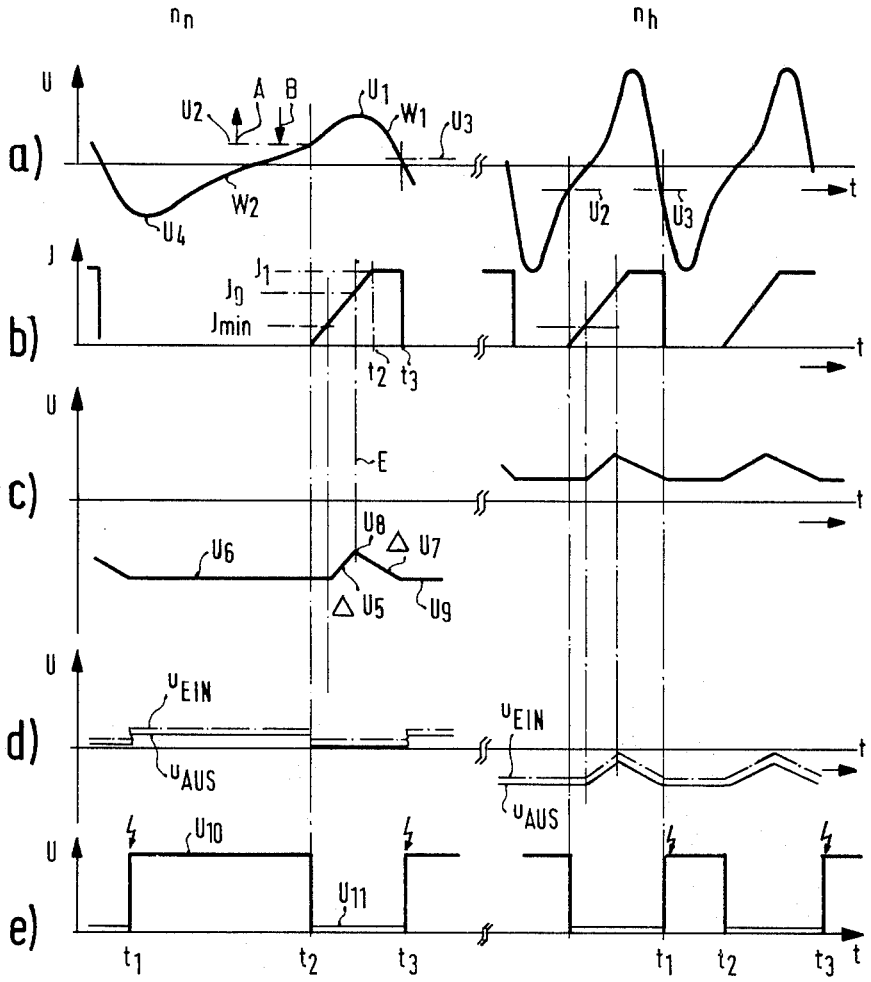

As shown in FIG. 2*a*, the control signal for operating threshold switch 15 should increase over a period of time relative to the potential at circuit point 14 to a peak value $U_1$ and then should decrease. Thus for the present case at least the half wave W1 of the signal furnished by timing signal generator 26 which is positive with respect to circuit point 14 can be utilized as a control signal. Threshold switch 15 is controlled by means of resistor 28 in such away that, during startup of the internal combustion engine, switch 15 may be switched in and switched out by the positive half wave. Thus, as clearly shown in FIG. 2*a*, when the internal combustion engine first starts up, the cut-in threshold U2 and the cut-out threshold U3 of threshold switch 15 are at a level only slightly above the zero line of the AC voltage furnished by timing signal generator 26.

This arrangement has the advantage that when the operating switch 2 is closed but the internal combustion engine is at rest, the emitter-collector circuit of transistor 7' is definitely in a blocked state, so that no current can flow over primary winding 5 of the ignition coil. Such a current could lead to excessive heating of ignition coil and possibly to its destruction.

As the internal combustion engine increases in speed, the cut-in threshold U2 moves first in the direction of arrow A towards the peak value $U_1$ of the positive half wave W1. For further increasing speeds, threshold U2 moves away from peak value $U_1$ in the direction of arrow B. The shifting of threshold U2 away from peak value $U_1$ can extend almost down to the negative peak value U4 of the signal furnished by timing signal generator 26.

As long as the speed of the internal combustion engine is increasing, the cut-out threshold U3 is maintained at its original value until such time as the cut-in threshold U2 has reached its original value during its movement away from peak value $U_1$. As soon as the cut-in threshold U2 has reached its original position, a further increase in the speed of the internal combustion engine causes the cut-out threshold U3 to be moved jointly with cut-in threshold U2 in the direction of arrow B. Specifically, the cut-out threshold will precede the cut-in threshold by at least a small amount.

The shifting of the cut-in threshold U2 takes place as follows. First, when the current in the primary winding of the ignition coil reaches a predetermined value $I_{min}$ a first change $\Delta U_5$ of the then present integration value $U_6$ in integrator 31 takes place. The end of the first change $\Delta U_5$ and the beginning of a subsequent change $\Delta U_7$ takes place when the current in the primary winding 5 of the ignition coil has reached a monitoring value $I_0$. The variation with respect to time of primary current in ignition coil 6 is shown in FIG. 2*b*. The end of the second change $\Delta U_7$ is determined by the cut-out of threshold switch 15. The value $U_9$ now stored in integrator 31 remains there until the next subsequent first change. This maintaining of a value stored on a capacitor is particularly readily accomplished by the use of an operational amplifier. Preferably, the first change $\Delta U_5$ and the second change $\Delta U_7$ are so adjusted that, when the speed of the internal combustion engine remains constant, the changes are symmetrical relative to a perpendicular E drawn through the value $U_8$, namely the value at the end of the change $\Delta U_5$ and at the start of the change $\Delta U_7$. The change from $\Delta U_5$ to $\Delta U_7$ is determined by choice of the monitored current $I_0$. After the value of current $I_0$ is reached, the current in the primary winding is allowed to increase until it reaches a value $I_1$ for which a sufficient energy for ignition is stored in ignition coil 6.

In the present case, the changes $\Delta U_5$ and $\Delta U_7$ are achieved by DC currents of opposite polarity, the DC current causing the change $\Delta U_5$ having a higher level as will be explained in greater detail below.

Finally, it should be noted that the voltage at output 19 of threshold switch 15, which is shown in FIG. 2*e* and whose cut-in and cut-out thresholds are shown in FIG. 2*d*, should be a potential $U_{10}$ when threshold switch 15 is cut off, that is in the time interval between $t_1$ and $t_2$. Potential $U_{10}$ should be substantially equal to the potential of the positive supply line 3. Similarly, the potential $U_{11}$ at output 19 when threshold switch 15 is cut in, that is in the time interval between $t_2$ and $t_3$, should be at least approximately equal to that on the negative supply line 4.

OPERATION

As soon as the voltage furnished by timing signal generator 26 reaches the cut-in threshold value $U_2$ following closure of operating switch 2, the potential $U_{11}$ appears at the output 19 of the switch. As mentioned above, this potential is approximately equal to that of the negative supply line 4. This causes transistor 41 to be switched to the conductive state through the base voltage divider 42, 43. Simultaneously, transistor 73 is blocked so that sufficient base current can now flow over resistor 75 and diode 84 to transistor 7', causing the latter to become conductive. Current starts to flow through primary winding 5, the collector-emitter circuit of transistor 7' and monitoring resistor 8.

As mentioned above, the cut-in threshold $U_2$ at the start of the engine is only a short value away from the zero line, that is only slightly above the potential at circuit point 14, so that threshold switch 15 will be reliably switched in even during the start-up of the engine.

As soon as the current through primary winding 5 reaches a predetermined minimum value $I_{min}$, which causes a corresponding voltage drop across monitoring resistor 8, transistor 57 which was previously conductive becomes blocked and blocks transistor 68. This causes transistor 45 to be switched to the conductive state so that a constant DC current flows over resistor 47 and the emitter-collector circuit of transistor 45 to integrator 31 (i.e. capacitor 44). This causes the first change $\Delta U_5$ to take place across integrator 31. This change ends as soon as the current through primary winding 5 reaches the monitoring value $I_0$. At this point the voltage drop across resistor 8 has a value at which transistor 53 is switched to the blocked state. This causes transistor 45 to block and transistor 46 to be switched to the conductive state, since its base-emitter circuit now receives current through the emitter-collector circuit of transistor 41. Since the emitter-collector circuit of transistor 46 is now conductive, the second change $\Delta U_7$ takes place, starting at the value $U_8$ present at the beginning of the blocking of transistor 45. The second change, $\Delta U_7$, ends as soon as the signal furnished by timing signal generator 26 reaches the cut-out threshold $U_3$ of switch 15. Thereafter the potential $U_{10}$ appears at output 19 of threshold switch 15, this potential being approximately equal to the potential of the positive supply line 3. The change in potential at the output of threshold switch 15 at time $t_2$ causes transistor 41 to block. Current no longer flows over the base-emitter circuit of transistor 41, causing its emitter-collector circuit to switch to the blocked state. This cuts off the current for the base-emitter circuit of transistor 46 causing its emitter-collector circuit to become blocked. This ends the second change $\Delta U_7$ at integrator 31. The jump in potential at the output of threshold switch 15 causes base current to be supplied to transistor 73 through resistor 77. Transistor 73 switches to the conductive state causing base current to be shunted away from transistor 7'. Transistor 7' blocks, interrupting the current through the primary winding 5 of ignition coil 6. The interruption of current causes a high voltage to be induced in secondary winding 9, which causes a spark to be generated at spark plug 10.

In the ignition system of FIG. 1, transistor 73 further functions to prevent further increases in the current through the primary winding 5 of ignition coil 6 after it has reached a predetermined value $I_1$ required for proper ignition. Specifically, when the voltage across resistor 8 reaches a value corresponding to the current $I_2$, the voltage at circuit point 71 as determined by resistor 69 causes the conductivity of transistor 73 to increase so that transistor 7' no longer receives full base current and therefore decreases the current through primary winding 5 to the predetermined value $I_1$. The circuit for limiting the primary current should be so designed that, when the internal combustion engine starts up, the current through the primary winding 5 will remain at the value $I_1$ for a time interval ($t_2'$ to $t_3$) so that during acceleration of the vehicle driven by the internal combustion engine enough ignition energy will be stored in the ignition coil in spite of the shortening of the time during which current flows. When the engine first starts up, the second change $\Delta U_7$ takes place over a longer time interval than the first change $\Delta U_5$, so that the final value $U_9$ stored in the integrator after the second change $\Delta U_7$ is always more negative than was the value $U_6$ prior to the first change $\Delta U_5$. Because of the presence of the circuit connected to line 29 (36, 37, 33) this affects the inverting input 17 in such a way that the cut-in threshold $U_2$ of the switch changes in a positive direction (arrow A). As the speed of the internal combustion engine increases, the second change $\Delta U_7$ taking place at integrator 31 will extend over a smaller time interval than the first change $\Delta U_5$, so that the integration value $U_9$ following the second change $\Delta U_7$ will be more positive than the integration value $U_6$ prior to the first change $\Delta U_5$. This, in turn, affects the inverting input 17 (via the circuit connected to line 29, and, after the integration value $U_9$ is positive, relative to circuit point 14 through the circuit connected to line 30), in such a way that the threshold $U_2$ changes in the negative direction (arrow B). It should be noted that the circuit connected to line 30 (34, 35) is of lower resistance than the circuit connected to line 29. Thus, when the engine first starts up, the primary winding 5 receives sufficient current to allow proper ignition, the current limiting circuit including transistor 73 becoming effective and transistor 7' being temporarily in an active state, that is having relatively high losses. This, however, only occurs in a speed region of the engine which immediately follows startup and ends very rapidly. The undesirable losses are compensated for by the fact that the shifting of the cut-in threshold $U_2$ of threshold switch 15 from the region of the peak value $U_1$ of the positive half wave into the region of the peak value $U_4$ of the negative half wave W2 allows a relatively constant energy to be stored in ignition coil 6 up to a relatively high engine speed.

When transistor 41 switches to the conductive state, the circuit including diode 40, resistor 39 and diode 38 becomes effective, causing the common point of resistors 36, 37 to be approximately at the potential of circuit point 14 when threshold switch 15 is switched in. Changes in the value stored on integrator 31 therefore do not affect threshold switch 15. The cut-out value $U_3$ of threshold switch 15 therefore has a stabilized value as long as the cut-in threshold value $U_2$ moves in the region between its original position and the peak value $U_1$ of positive half wave W1. Integrator 31 thus cannot have any deleterious effect on the ignition timing. At higher engine speeds this stabilization is no longer required, because a relatively rapid decrease of AC voltage from the peak value $U_1$ then takes place.

On the other hand, for high engine speeds, the time in which transistor 7' is blocked can be so short that a residual storage effect results. Since energy would then still be stored in ignition coil 6 when transistor 7' again becomes conductive, the primary winding through the ignition coil would jump to a value which is higher than zero. This in turn would result to an undesired shortening of the time during which the first change $\Delta U_5$ occurs. In order to prevent this, the first change $\Delta U_5$ in accordance with the present invention is only carried out after the current through the primary winding has reached a minimum value $I_{min}$, the value $I_{min}$ being higher than the maximum starting current to be expected through primary winding 5. Thus definite starting conditions for change $\Delta U_5$ are established and the above-mentioned undesired shortening of the closure time is prevented.

The present invention need not be limited to the example shown in the drawing. The same principle can be applied to different types of ignition systems for example those without $\alpha_s$ control as, for example, ignition systems with Hall generators. In that case the voltage would be used to control a timing stage.

Various changes and modifications may be made within the scope of the inventive concepts.

We claim:

1. In an ignition system having an ignition coil (6) having a primary winding (5), electronic interrupter switch means (7) connected in series with said primary winding, threshold circuit means (15) connected to said electronic interrupter switch means for controlling the operation thereof, and control circuit means for varying the cut-in threshold of said threshold circuit means so that the closure angle of said electronic interrupter switch means varies as a function of engine speed, said control circuit means including integrator circuit means for varying the cut-in threshold of said threshold circuit means in accordance with DC current supplied thereto, the improvement comprising means connected to said integrator means and responsive to said current through siad primary winding of said ignition coil for supplying DC current to said integrator means thereby changing said cut-in threshold of said threshold circuit means only when said current through said primary winding has reached a predetermined minimum value ($I_{min}$) exceeding the maximum possible residual current in said primary winding of said ignition coil when said electronic interrupter switch closes, whereby said variation of said cut-in threshold of said threshold circuit means is independent of residual current present in said ignition coil when said electronic interrupter switch closes.

2. An ignition system as set forth in claim 1, wherein said DC current supplying means comprises a monitoring resistor (8) connected in series with said electronic interrupter switch means, and blocking circuit means (57) connected to said monitoring resistor and said integrator circuit means for blocking DC current flow to said integrator circuit means until said voltage across said monitoring resistor reaches a predetermined minimum value corresponding to said predetermined minimum value of said current through said primary winding of said ignition coil.

3. An ignition system as set forth in claim 2, further comprising means (60–66) for furnishing a stabilized voltage to said blocking circuit means.

4. An ignition system as set forth in claim 3, wherein said blocking circuit means comprises a transistor having an emitter-collector circuit directly connected to said monitoring resistor.

5. An ignition system as set forth in claim 4, wherein said DC current supplying means comprises a DC current source (45) and an additional transistor (68) having a base circuit connected to said emitter-collector of said blocking transistor for controlling current flow from said constant current source.

* * * * *